US007391398B2

(12) United States Patent
Inoue

(10) Patent No.: US 7,391,398 B2
(45) Date of Patent: Jun. 24, 2008

(54) METHOD AND APPARATUS FOR DISPLAYING HALFTONE IN A LIQUID CRYSTAL DISPLAY

(75) Inventor: Akihiko Inoue, Kyoto (JP)

(73) Assignee: SHARP Kabushiki Kaisha, Osaka (JP)

( * ) Notice: Subject to any disclaimer, the term of this patent is extended or adjusted under 35 U.S.C. 154(b) by 782 days.

(21) Appl. No.: 10/870,163

(22) Filed: Jun. 18, 2004

(65) Prior Publication Data

US 2004/0257325 A1 Dec. 23, 2004

(30) Foreign Application Priority Data

Jun. 19, 2003 (JP) ..... 2003-175251

(51) Int. Cl.
*G09G 3/36* (2006.01)

(52) U.S. Cl. ..... 345/89; 345/96

(58) Field of Classification Search ..... 345/87–89, 345/96, 209, 690

See application file for complete search history.

(56) References Cited

U.S. PATENT DOCUMENTS 5,552,800 A 9/1996 Uchikoga et al.
6,219,019 B1 * 4/2001 Hasegawa et al. ..... 345/96
6,396,485 B1 * 5/2002 Minami ..... 345/204
6,665,023 B1 * 12/2003 Watanabe et al. ..... 349/38
2004/0150612 A1 * 8/2004 Okuzono et al. ..... 345/100

FOREIGN PATENT DOCUMENTS

| | | |
|---|---|---|
| CN | 1060548 | 4/1992 |
| JP | 6-138846 | 5/1994 |
| JP | 8-43795 | 2/1996 |
| JP | 2001-34239 | 2/2001 |

* cited by examiner

*Primary Examiner*—Ricardo Osorio
(74) *Attorney, Agent, or Firm*—Harness, Dickey & Pierce, P.L.C.

(57) ABSTRACT

An liquid crystal display (LCD) device uses a method for displaying halftone without causing luminance differences among pixels when an FRC technique is used, and without causing stripe-shaped luminance variations when a flicker component is eliminated spatially. The LCD device includes a data splitter, a pixel location detecting circuit, a frame number determining circuit, an applied timing memory circuit, an applied voltage determining circuit, a summation process circuit, and a timing adjusting circuit. The LCD device determines driving voltages such that for each of a high voltage or a low voltage during these 2N frames, the number of applying positive voltages is the same as the number of applying negative voltages where a unit period is 2N frames for multi-gray-level display of (1+N) levels. The LCD device can improve image quality since the average luminance of each pixel is made uniform.

8 Claims, 14 Drawing Sheets

| GRAY LEVEL 3 APPLIED VOLTAGE NAME | FRAME NUMBER | | | | | | | |
|---|---|---|---|---|---|---|---|---|
| | 1 | 2 | 3 | 4 | 5 | 6 | 7 | 8 |
| 10a | L+ | H− | H+ | L− | H+ | L− | L+ | H− |
| 10b | H+ | L− | L+ | H− | L+ | H− | H+ | L− |
| 10c | L− | H+ | L− | H+ | H− | L+ | H− | L+ |
| 10d | H− | L+ | H− | L+ | L− | H+ | L− | H+ |

2×2 PIXEL PATTERN

| APPLIED VOLTAGE NAME | FRAME NUMBER | | | | | | | |
|---|---|---|---|---|---|---|---|---|
| | 1 | 2 | 3 | 4 | 5 | 6 | 7 | 8 |
| exV | L+ | H− | H+ | H− | H+ | L− | H+ | H− |

| | |
|---|---|
| a | b |
| c | d |

*Fig. 4*

| GRAY LEVELS | PIXEL PATTERN EXAMPLES |
|---|---|
| GRAY LEVEL:0% | |
| GRAY LEVEL:25% | |
| GRAY LEVEL:50% | |
| GRAY LEVEL:75% | |
| GRAY LEVEL:100% | |

□ ···BRIGHT PIXEL ▨ ···DARK PIXEL

*Fig. 5*

| | | | | | | | |
|---|---|---|---|---|---|---|---|
| a | b | a | b | a | b | a | b |
| d | c | d | c | d | c | d | |
| a | b | a | b | a | b | a | |
| d | c | d | c | d | c | d | |
| a | b | a | b | a | b | a | |
| d | c | d | c | d | c | | |
| a | b | a | b | a | | | |
| d | c | | | | | | |

| GRAY LEVEL 1 APPLIED VOLTAGE NAME | FRAME NUMBER | | | | | | | |
|---|---|---|---|---|---|---|---|---|
| | 1 | 2 | 3 | 4 | 5 | 6 | 7 | 8 |
| 00a, 00b | L+ | L− | L+ | L− | L+ | L− | L+ | L− |
| 00c, 00d | L− | L+ | L− | L+ | L− | L+ | L− | L+ |

2×2 PIXEL PATTERN

| GRAY LEVEL 2 APPLIED VOLTAGE NAME | FRAME NUMBER | | | | | | | |
|---|---|---|---|---|---|---|---|---|
| | 1 | 2 | 3 | 4 | 5 | 6 | 7 | 8 |
| 01a | H+ | L− | L+ | L− | L+ | H− | L+ | L− |
| 01b | L+ | L− | L+ | H− | L+ | L− | H+ | L− |
| 01c | L− | L+ | H− | L+ | L− | L+ | L− | H+ |
| 01d | L− | H+ | L− | L+ | H− | L+ | L− | L+ |

2×2 PIXEL PATTERN

| GRAY LEVEL 3 APPLIED VOLTAGE NAME | FRAME NUMBER | | | | | | | |
|---|---|---|---|---|---|---|---|---|
| | 1 | 2 | 3 | 4 | 5 | 6 | 7 | 8 |
| 10a | L+ | H− | H+ | L− | H+ | L− | L+ | H− |
| 10b | H+ | L− | L+ | H− | L+ | H− | H+ | L− |
| 10c | L− | H+ | L− | H+ | H− | L+ | H− | L+ |
| 10d | H− | L+ | H− | L+ | L− | H+ | L− | H+ |

2×2 PIXEL PATTERN

| GRAY LEVEL 4 APPLIED VOLTAGE NAME | FRAME NUMBER | | | | | | | |
|---|---|---|---|---|---|---|---|---|
| | 1 | 2 | 3 | 4 | 5 | 6 | 7 | 8 |
| 11a | L+ | H− | H+ | H− | H+ | L− | H+ | H− |
| 11b | H+ | H− | H+ | L− | H+ | H− | L+ | H− |
| 11c | H− | H+ | L− | H+ | H− | H+ | H− | L+ |
| 11d | H− | L+ | H− | H+ | L− | H+ | H− | H+ |

2×2 PIXEL PATTERN

| | | | | | | | | | | | | | | | | | | | |
|---|---|---|---|---|---|---|---|---|---|---|---|---|---|---|---|---|---|---|---|
| 64 | 64 | 64 | 64 | 65 | 65 | 65 | 65 | 66 | 66 | 66 | 66 | 67 | 67 | 67 | 67 | 68 | 68 | 68 | 68 |
| 64 | 64 | 64 | 64 | 65 | 65 | 65 | 65 | 66 | 66 | 66 | 66 | 67 | 67 | 67 | 67 | 68 | 68 | 68 | |
| 64 | 64 | 64 | 64 | 65 | 65 | 65 | 65 | 66 | 66 | 66 | 66 | 67 | 67 | 67 | 67 | 68 | 68 | 68 | |
| 64 | 64 | 64 | 64 | 65 | 65 | 65 | 65 | 66 | 66 | 66 | 66 | 67 | 67 | 67 | 67 | 68 | 68 | 68 | |
| 64 | 64 | 64 | 64 | 65 | 65 | 65 | 65 | 66 | 66 | 66 | 66 | 67 | 67 | 67 | 67 | 68 | 68 | | |
| 64 | 64 | 64 | 64 | 65 | 65 | 65 | 65 | 66 | 66 | 66 | | | | | | | | | |

Fig. 14

| | | | | | | | | | | | | | | | | | | | |
|---|---|---|---|---|---|---|---|---|---|---|---|---|---|---|---|---|---|---|---|
| 64+ | 64+ | 64+ | 64+ | 64+ | 64+ | 64+ | 64+ | 68+ | 64+ | 68+ | 64+ | 68+ | 68+ | 68+ | 68+ | 68+ | 68+ | 68+ | 68+ |
| 64- | 64- | 64- | 64- | 64- | 68- | 64- | 68- | 68- | 64- | 68- | 64- | 68- | 64- | 68- | 64- | 68- | 68- | 68- | |
| 64+ | 64+ | 64+ | 64+ | 64+ | 64+ | 64+ | 64+ | 68+ | 64+ | 68+ | 64+ | 68+ | 68+ | 68+ | 68+ | 68+ | 68+ | 68+ | |
| 64- | 64- | 64- | 64- | 64- | 68- | 64- | 68- | 68- | 64- | 68- | 64- | 68- | 64- | 68- | 64- | 68- | 68- | | |
| 64+ | 64+ | 64+ | 64+ | 64+ | 64+ | 64+ | 64+ | 68+ | 64+ | 68+ | 64+ | 68+ | 68+ | 68+ | 68+ | | | | |
| 64- | 64- | 64- | 64- | 64- | 68- | 64- | 68- | 68- | 64- | 68- | | | | | | | | | |

Fig. 15

| | | | | | | | | | | | | | | | | | | | |
|---|---|---|---|---|---|---|---|---|---|---|---|---|---|---|---|---|---|---|---|
| 64- | 64- | 64- | 64- | 64- | 68- | 64- | 68- | 64- | 68- | 64- | 68- | 68- | 64- | 68- | 64- | 68- | 68- | 68- | 68- |
| 64+ | 64+ | 64+ | 64+ | 64+ | 64+ | 64+ | 64+ | 64+ | 68+ | 64+ | 68+ | 68+ | 68+ | 68+ | 68+ | 68+ | 68+ | 68+ | |
| 64- | 64- | 64- | 64- | 64- | 68- | 64- | 68- | 64- | 68- | 64- | 68- | 68- | 64- | 68- | 64- | 68- | 68- | 68- | |
| 64+ | 64+ | 64+ | 64+ | 64+ | 64+ | 64+ | 64+ | 64+ | 68+ | 64+ | 68+ | 68+ | 68+ | 68+ | 68+ | 68+ | 68+ | | |
| 64- | 64- | 64- | 64- | 64- | 68- | 64- | 68- | 64- | 68- | 64- | 68- | 68- | 64- | 68- | 64- | | | | |
| 64+ | 64+ | 64+ | 64+ | 64+ | 64+ | 64+ | 64+ | 64+ | 68+ | 64+ | | | | | | | | | |

*Fig. 16*

| | | | | | | | | | | | | | | | | | | | |
|---|---|---|---|---|---|---|---|---|---|---|---|---|---|---|---|---|---|---|---|
| 64+ | 64+ | 64+ | 64+ | 64+ | 64+ | 64+ | 64+ | 68+ | 64+ | 68+ | 64+ | 68+ | 68+ | 68+ | 68+ | 68+ | 68+ | 68+ | 68+ |
| 64- | 64- | 64- | 64- | 68- | 64- | 68- | 64- | 64- | 68- | 64- | 68- | 64- | 68- | 64- | 68- | 68- | 68- | 68- | |
| 64+ | 64+ | 64+ | 64+ | 64+ | 64+ | 64+ | 64+ | 68+ | 64+ | 68+ | 64+ | 68+ | 68+ | 68+ | 68+ | 68+ | 68+ | 68+ | |
| 64- | 64- | 64- | 64- | 68- | 64- | 68- | 64- | 64- | 68- | 64- | 68- | 64- | 68- | 64- | 68- | 68- | 68- | | |
| 64+ | 64+ | 64+ | 64+ | 64+ | 64+ | 64+ | 64+ | 68+ | 64+ | 68+ | 64+ | 68+ | 68+ | 68+ | 68+ | | | | |
| 64- | 64- | 64- | 64- | 68- | 64- | 68- | 64- | 64- | 68- | 64- | | | | | | | | | |

*Fig. 17*

| | | | | | | | | | | | | | | | | | | | |
|---|---|---|---|---|---|---|---|---|---|---|---|---|---|---|---|---|---|---|---|
| 64- | 64- | 64- | 64- | 68- | 64- | 68- | 64- | 64- | 68- | 64- | 68- | 64- | 68- | 64- | 68- | 68- | 68- | 68- | 68- |
| 64+ | 64+ | 64+ | 64+ | 64+ | 64+ | 64+ | 64+ | 68+ | 64+ | 68+ | 64+ | 68+ | 68+ | 68+ | 68+ | 68+ | 68+ | 68+ | |
| 64- | 64- | 64- | 64- | 68- | 64- | 68- | 64- | 64- | 68- | 64- | 68- | 64- | 68- | 64- | 68- | 68- | 68- | 68- | |
| 64+ | 64+ | 64+ | 64+ | 64+ | 64+ | 64+ | 64+ | 68+ | 64+ | 68+ | 64+ | 68+ | 68+ | 68+ | 68+ | 68+ | 68+ | | |
| 64- | 64- | 64- | 64- | 68- | 64- | 68- | 64- | 64- | 68- | 64- | 68- | 64- | 68- | 64- | 68- | | | | |
| 64+ | 64+ | 64+ | 64+ | 64+ | 64+ | 64+ | 64+ | 68+ | 64+ | 68+ | | | | | | | | | |

*Fig. 23*
*PRIOR ART*

| COLUMN 1 | COLUMN 2 | COLUMN 3 | COLUMN 4 | |
|---|---|---|---|---|
| C | D | C | D | |
| E | F | E | F | |
| C | D | C | D | |
| E | F | E | F | |
| | | | | |

METHOD AND APPARATUS FOR DISPLAYING HALFTONE IN A LIQUID CRYSTAL DISPLAY

BACKGROUND OF THE INVENTION

1. Field of the Invention

The present invention relates generally to a method and an apparatus for displaying halftone in a liquid crystal display. More particularly, the present invention relates to a method and an apparatus for displaying halftone in a liquid crystal display by applying two different voltages periodically.

2. Description of the Related Art

Typically, a liquid crystal display (LCD) device contains a display panel in which a plurality of pixel circuits including liquid crystal elements are configured in a matrix; an LCD driver for applying a predetermined data signal to the pixel circuits of the display panel; and a selecting driver for applying a predetermined scanning signal to the display panel to select a predetermined pixel circuit. FIG. 20 illustrates an equivalent circuit diagram of the pixel circuit included in the LCD device. As illustrated, this pixel circuit includes a data signal line 101 for applying a data signal from the LCD driver; a scanning signal line 100 for applying a scanning signal from the selecting driver; a field effect transistor 102 functioning as a switching device in response to the scanning signal; a liquid crystal element 103 for adjusting quantity of display light through the pixel; and an auxiliary capacitance element 104 having predetermined capacitance. The field effect transistor 102 is connected to the scanning signal line 100 at its gate, and to the data signal line at its drain. Also, one end of the liquid crystal element 103 and the auxiliary capacitance element 104 is each connected to a source of the field effect transistor 102, and another end of these elements is each connected to a common electrode Vcom which is a common electrode for all the pixel circuits. In this pixel circuit, when the scanning signal is provided, i.e., the scanning signal line 100 is selected, the field effect transistor 102 turns on, thereby causing a voltage (of the data signal) applied to the data signal line to be applied to the auxiliary capacitance element 104. Then, once the period during which the scanning signal line 100 is selected ends, the field effect transistor 102 turns off, while a voltage across the capacitance at the beginning of this off state is maintained by electric charge stored (or held) in the auxiliary capacitance element 104. Here, since light transmissivity or light reflectivity of the liquid crystal element 103 varies depending on the applied voltage, application of a voltage corresponding to image data to the data signal line 101 enables display luminance (or display tone) of the pixel to be varied according to the image data when the scanning signal line 100 is selected.

Here, a driver for driving a digital LCD device selects one of a plurality of predetermined reference voltages based on digital data given externally, and applies the selected reference voltage to a pixel element in a specific pixel circuit. As the number of gray levels increases, this digital LCD driver requires an increased number of elements included therein, and thus, ends up in higher manufacturing cost. To deal with this problem, frame rate control techniques (hereinafter referred to as the "FRC techniques") have been developed as a control technique for increasing gray levels without increasing the number of devices used therein, while still using a digital LCD driver.

The FRC techniques achieve pseudo-halftone luminance for human eyes by applying two different driving voltages to a predetermined pixel element in multiple frames. FIGS. 21A-21C illustrate an example for multi-gray-level display (e.g., three-gray-level display) by an FRC technique. Here, two different driving voltages (i.e., "high" voltage and "low" voltage) are applied to a predetermined pixel element in adjoining frames 1 and 2, thereby allowing three-gray-level (i.e., multi-gray-level) display. In this case, the frame frequency is 60 Hz. An AC (alternate current) drive is performed by a frame inverting technique where the polarity of the applied voltage is inverted for each frame.

FIG. 21A illustrates a driving voltage in each frame for displaying a pixel A with lowest luminance, FIG. 21B illustrates a driving voltage in each frame for displaying a pixel B with highest luminance, and FIG. 21C illustrates a driving voltage in each frame for displaying a pixel C with a middle luminance. As shown in FIG. 21A, a low voltage with respect to the voltage potential VCOM of the common electrode applied in both frames 1 and 2 creates a pixel A with the lowest luminance. By contrast, as shown in FIG. 21B, a high voltage applied in both frames 1 and 2 creates a pixel B with the highest luminance. Then, as shown in FIG. 21C, a positive low voltage applied in frame 1, and a negative high voltage applied in frame 2 generate a pixel C with a middle luminance between the luminance of the pixel A shown in FIG. 21A and the luminance of the pixel B shown in FIG. 21B.

When the middle luminance shown in FIG. 21C is obtained by the FRC technique, a low-luminance pixel is displayed in frame 1, and a high-luminance pixel is displayed in frame 2. As a result, pixels with different luminances are displayed in adjoining frames. Thus, luminance variations of the displayed pixel C contains a flicker component which has a half of the frame frequency, i.e., 30 Hz. Here, in general, it is observed that flicker components whose frequency is lower than 50 Hz are noticeable for human eyes. Thus, if all pixels in a display screen are driven at the same phase as the middle-luminance pixel C shown in FIG. 21C, flicker components are conspicuous in the entire display screen. As a result, display quality of the display device would be deteriorated.

To address this issue, i.e., in order to achieve flickerless middle luminance of FIG. 21C, there have been techniques for spatially eliminating the associated flicker components by applying the driving voltage shown in FIG. 21C to some pixels, and by applying voltages different from that of FIG. 21C to other pixels, thereby allowing pixels displayed by these pixel circuits to be evenly positioned within a display screen in a diffused manner.

For example, in order to apply voltages different from that of FIG. 21C, the following three patterns may be used. In a first pattern, a positive high voltage is applied in frame 1, and a negative low voltage is applied in frame 2. In a second pattern, a negative high voltage is applied in frame 1, and a positive low voltage is applied in frame 2. In the third pattern, a negative low voltage is applied in frame 1, and a positive high voltage is applied in frame 2. FIGS. 22A-22C illustrate the above patterns in which these voltages are applied. FIG. 22A shows a driving voltage for the first pattern, and a pixel D generated by applying the driving voltage for the first pattern. FIG. 22B shows a driving voltage for the second pattern, and a pixel E generated by applying the driving voltage for the second pattern. FIG. 22C shows a driving voltage for the third pattern, and a pixel F generated by applying the driving voltage for the third pattern. These pixels D, E and F; and the pixel C shown in FIG. 21C are positioned to be diffused spatially, i.e., their positions in the display screen are evenly allocated. FIG. 23 illustrates an exemplary allocation of the pixels C, D, E, and F. FIG. 23 illustrates pixels in four rows for each of columns 1-4 where symbols C, D, E, and F in the figure correspond to the above-identified pixels C, D, E, and F, respectively. Positioning each pixel in this manner allows pixels generated by application of the same driving voltage to be diffused in the display screen in a specific frame, thereby spatially eliminating the above-mentioned flicker components.

According to the conventional FRC techniques described above assume that luminances of pixels generated by applying the same combination of driving voltages, e.g., luminances of pixels C, D, E, and F are identical with each other. However, there exists parasitic capacitance in the equivalent circuit including the field effect transistor 102 shown in FIG. 20. As a result, when two cases in which positive and negative voltages having the same driving voltage (high voltage or low voltage) are applied are compared with each other, the voltage potentials VDL, VDH, and VDM1-VDM4 shown in FIGS. 21A-21C and 22A-22C can be shifted from ideal levels. Thus, pixels generated by applying the same combination of driving voltages may have different luminances. For example, the middle luminance of pixels C and E, and the middle luminance of pixels D and F may be different from each other although these middle luminances should be the same.

The above-mentioned luminance differences may be noticeable for human eyes especially when flicker components are to be eliminated spatially. That is, the pixels C and E in the columns 1 and 3 are generated by being driven only by high voltages with positive polarity and negative polarity as shown in FIGS. 21C and 22B. The pixels D and F in the columns 2 and 4 are generated by being driven only by high voltage with positive polarity and low voltage with negative polarity as shown in FIGS. 22A and 22C. As a result, the luminances are the same on every other column while adjoining columns have different luminances with each other. Thus, stripe-shaped variations in luminance extending along the column direction is conspicuous for human eyes. Even if the pixels C and F shown in FIG. 23 are interchanged, this problem still remains, and in such a case, stripe-shaped variations in luminance extending along the row direction would be conspicuous.

SUMMARY OF THE INVENTION

In view of the foregoing, one objective of the invention is to provide a halftone display method, and a display device using the halftone display method, which do not cause the above-described luminance differences when a halftone display method according to an FRC technique is used. Another objective of the invention is to provide a halftone display method, and a display device using the halftone display method, which do not cause stripe-shaped luminance variations when a halftone display method according to an FRC technique is used to eliminate spatially a flicker component.

In order to achieve the above-identified objectives, the present invention has advantages described below.

According to one aspect of the invention, a method for displaying (1+N)-level (N is a natural number more than 2) halftone in a liquid crystal display based on a first and a second driving voltages selected for a predetermined unit period among a plurality of predetermined driving voltages is provided. The one of the first and the second driving voltages is set for each of frames included in the unit period. A polarity of the one of the first and the second driving voltages is inverted for every one or more frames. The method includes generating the first driving voltage and the second driving voltage such that a number of frames to which the first driving voltage having a positive polarity is assigned is the same as a number of frames to which the first driving voltage having a negative polarity is assigned, and such that a number of frames to which the second driving voltage having a positive polarity is assigned is the same as a number of frames to which the second driving voltage having a negative polarity is assigned, where the unit period includes 2N frames.

By employing the above-described method, during 2N frames where the unit period includes 2N frames for displaying (1+N) levels of halftone, the number of applying high voltage or low voltage with a positive polarity is the same as the number of applying high voltage or low voltage with a negative polarity. As a result, an average luminance of each pixel which should have the same luminance is uniform, thereby improving image quality.

In one specific embodiment, a number of frames to which the first driving voltage is assigned in a first half containing N frames in the unit period is the same as a number of frames to which the first driving voltage is assigned in a latter half containing N frames in the unit period, and a number of frames to which the second driving voltage is assigned in the first half containing N frames in the unit period is the same as a number of frames to which the second driving voltage is assigned in the latter half containing N frames in the unit period.

By employing the above-described embodiment, the numbers of applying two different driving voltages within each half containing N frames obtained by dividing the unit period of 2N frames into a first half and a latter half are set to be the same with each other. As a result, average luminances during the first half and the latter half each containing N frames are substantially the same with each other, thereby enabling high quality display in which generation of flicker is reduced.

In another embodiment, the driving voltage for the k-th frame in the unit period is equal to the driving voltage for the (N+k+1)-th frame in the unit period, and the driving voltage for the (k+1)-th frame in the unit period is equal to the driving voltage for the (N+k)-th frame in the unit period where N is an even number, and k is an odd number less than N, and the driving voltage for m-th frame in the unit period is equal to the driving voltage for (m+N)-th frame in the unit period where N is an odd number, and m is a natural number equal to or less than N. Specifically, for example, when the unit period contains 8 frames, the driving voltage for the first frame in the unit period is equal to the driving voltage for the sixth frame in the unit period, the driving voltage for the second frame in the unit period is equal to the driving voltage for the fifth frame in the unit period, the driving voltage for the third frame in the unit period is equal to the driving voltage for the eighth frame in the unit period, and the driving voltage for the fourth frame in the unit period is equal to the driving voltage for the seventh frame in the unit period. As a result, the number of applying the same driving voltage during the adjoining frames is minimized, thereby improving quality further as compared to a case where the first half and the latter half of the unit period are set to have the same driving voltage sequence.

In still another embodiment, in order to display multi-level tones for a display unit including a plurality of pixels, the first and the second driving voltages may be set to display a predetermined gray level for each pixel included in the display unit.

As a result, by displaying multi-level tones by the display unit including a plurality of pixels, the number of gray levels is increased, and a flicker component is eliminated spatially.

According to another aspect of the invention, an apparatus for displaying (1+N)-level (N is a natural number equal to or more than 2) halftone in a liquid crystal display in response to display data given external to the apparatus, based on one of a first and a second driving voltages selected for a predetermined unit period among a plurality of predetermined driving voltages is provided. The one of the first and the second driving voltages is set for each of frames included in the unit period. A polarity of the one of the first and the second driving voltages is inverted every one or more frames. The apparatus includes a voltage determining circuit for generating the first driving voltage and the second driving voltage such that a number of frames to which the first driving voltage having a positive polarity is assigned is the same as a number of frames to which the first driving voltage having a negative polarity is assigned, and such that a number of frames to which the second driving voltage having a positive polarity is assigned is the same as a number of frames to which the second driving voltage having a negative polarity is assigned, where the unit period includes 2N frames; and a display portion for displaying multi-level tones based on the driving voltages generated by the voltage determining circuit.

In one embodiment, the voltage determining circuit may include a frame determining circuit for determining a frame corresponding to the display data among 2N frames constituting the unit period, a timing memory circuit for storing the driving voltages assigned to the unit period in association with a frame included in the unit period, and an applied voltage determining circuit for applying to the display portion, based on the frame determined by the frame determining circuit, the driving voltages associated with the determined frame stored in the timing memory circuit.

In another embodiment, in order to display multi-level tones for a display unit including a plurality of pixels, the voltage determining circuit may set the first and the second driving voltages to display a predetermined gray level for each pixel included in the display unit.

These and other objects, features, aspects and advantages of the present invention will become more apparent from the following detailed description of the present invention when taken in conjunction with the accompanying drawings.

BRIEF DESCRIPTION OF THE DRAWINGS

The present invention is illustrated by way of example, and not by way of limitation, in the figures of the accompanying drawings and in which like reference numerals refer to similar elements and in which:

FIG. 4 illustrates a pixel pattern, and a resulting gray level obtained by the pixel pattern according to the one of the embodiments.

FIG. 5 illustrates an example of positioning the pixels in the liquid crystal panel according to the one of the embodiments.

FIG. 14 illustrates digital data representing a gray level for each pixel in the frame number 3 according to the one of the embodiments.

FIG. 15 illustrates digital data representing a gray level for each pixel in the frame number 4 according to the one of the embodiments.

FIG. 16 illustrates digital data representing a gray level for each pixel in the frame number 5 according to the one of the embodiments.

FIG. 17 illustrates digital data representing a gray level for each pixel in the frame number 6 according to the one of the embodiments.

FIG. 23 illustrates an exemplary allocation of the pixels C, D, E, and F shown in FIGS. 22A-22C.

DETAILED DESCRIPTION OF THE INVENTION

An embodiment of the invention will be described with reference to the accompanying drawings.

A liquid crystal display (LCD) device according to one of various embodiments of the invention performs operational process on an image signal input having digital 24 bits (8 bits for each of R, G and B) based on a method for displaying halftone (multi-gray-level) described in detail below. This process allows displaying images with image quality equivalent to digital 24 bits although an LCD panel of the LCD device is configured to receive digital 18 bits (6 bits for each of R, G and B).

Here, R, G and B refer to red, green and blue, respectively, used for display devices. Although the number of primary colors used for displaying images is typically three, other suitable numbers of primary colors, for example, four, may be used.

Figure 1:
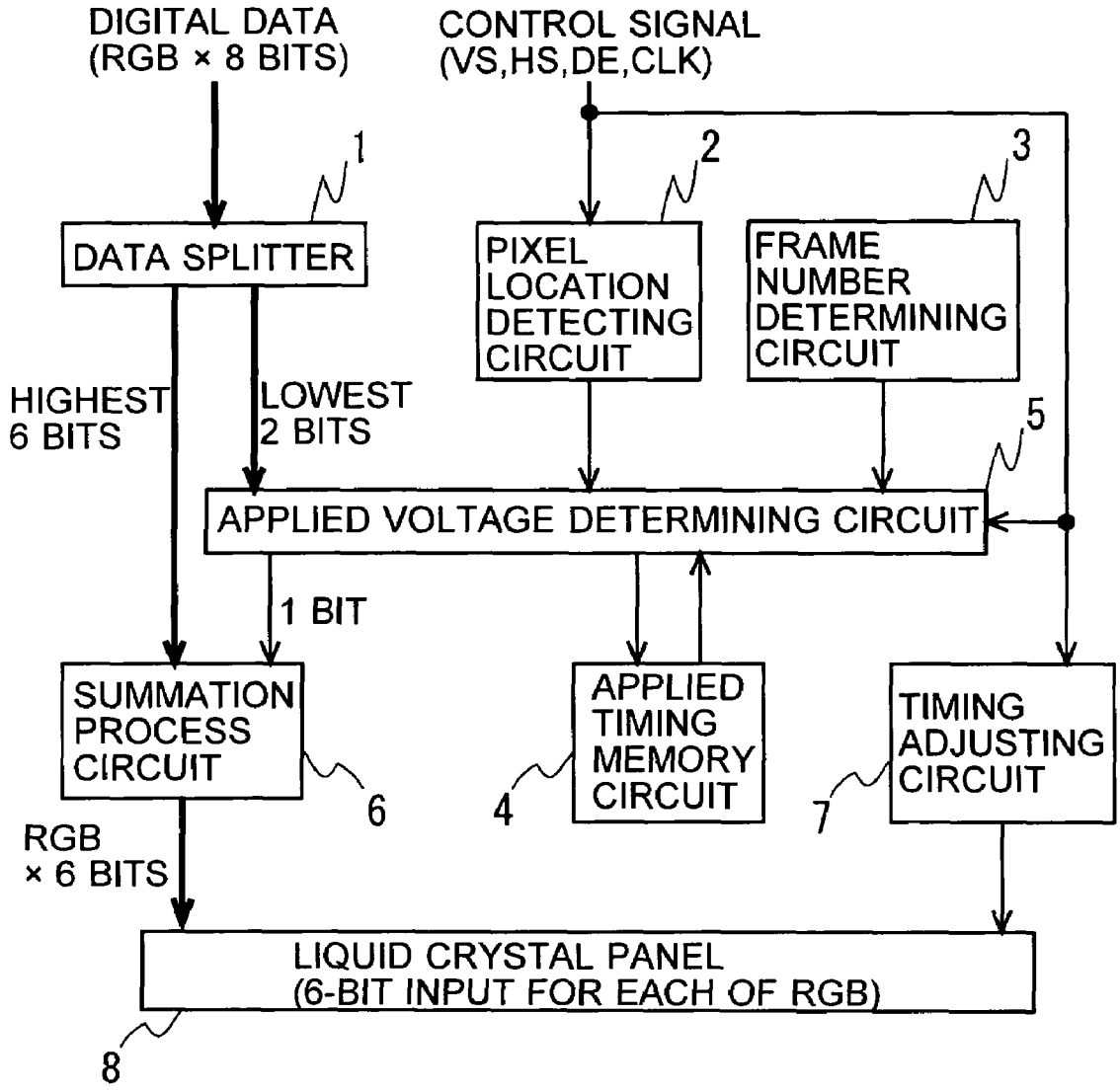
FIG. 1 illustrates a block diagram showing a configuration of the LCD device according to one of the embodiments of the present invention.
Figure 20:
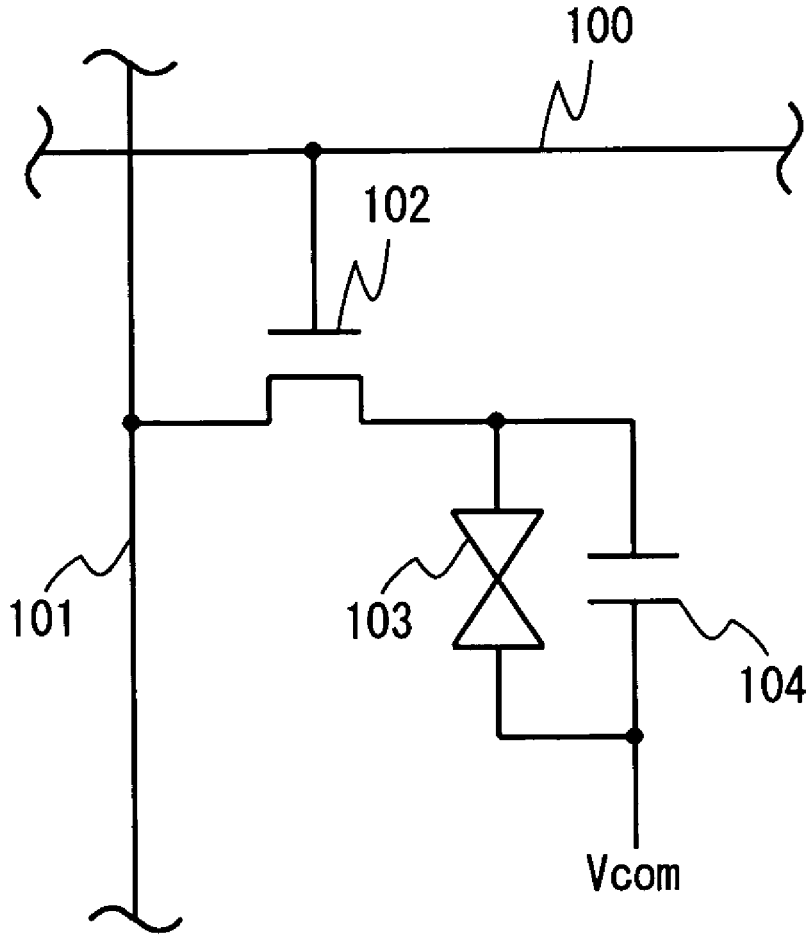
Fig. 20 PRIOR ART
FIG. 20 illustrates an equivalent circuit diagram of the pixel circuit included in a conventional LCD device.

FIG. 1 illustrates a block diagram showing a configuration of the LCD device. In order to process each color component of R, G and B, this LCD device includes, for each of R, G and B, a data splitter 1, a pixel location detecting circuit 2, a frame number determining circuit 3, an applied timing memory circuit 4, an applied voltage determining circuit 5, a summation process circuit 6, and a timing adjusting circuit 7. These functional blocks cooperate to generate a digital signal by performing predetermined digital signal processing. The LCD device further includes a liquid crystal panel 8 containing a plurality of pixel element circuits each of which has a liquid crystal element such that the plurality of pixel element circuits are configured in a matrix to function as a display portion of the LCD device for displaying images having image quality equivalent to digital 24 bits based on the digital signal. In this specific embodiment, the liquid crystal panel 8 includes an LCD driver for applying a data signal to a predetermined pixel circuit, and a selecting driver for applying a predetermined scanning signal for selecting a predetermined pixel circuit. However, it should be appreciated that these drivers may be provided external to the liquid crystal panel 8. The pixel circuit employs a configuration similar to that of a conventional pixel circuit as shown in FIG. 20, and thus, its further description is omitted herein. An image signal supplied to this LCD device contains eight-bit digital data for each color of R, G and B. Also, together with the image signal, the LCD device is supplied with typical digital control signals including, but not limited to, a vertical synchronizing signal (VS), a horizontal synchronizing signal (HS), a data enable signal (DE), and a clock signal (CLK).

Figure 21A:
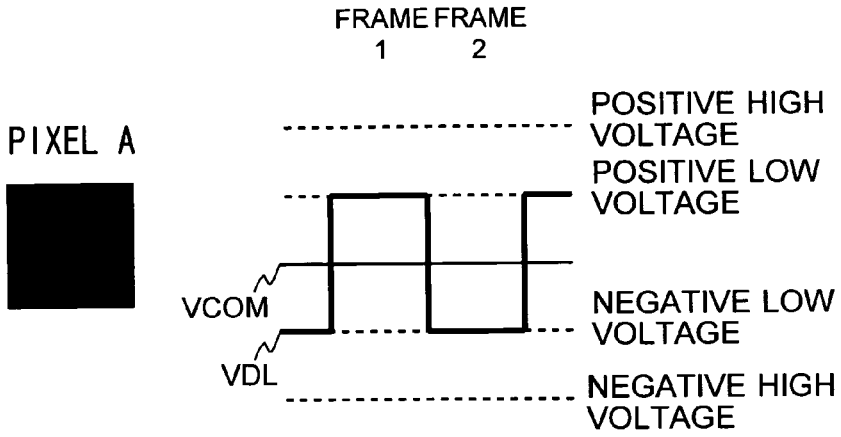
Fig. 21A PRIOR ART
FIG. 21A illustrates a driving voltage in each frame for displaying a pixel A with lowest luminance in an example of 3-gray-level display according to a conventional FRC technique.
Figure 21B:
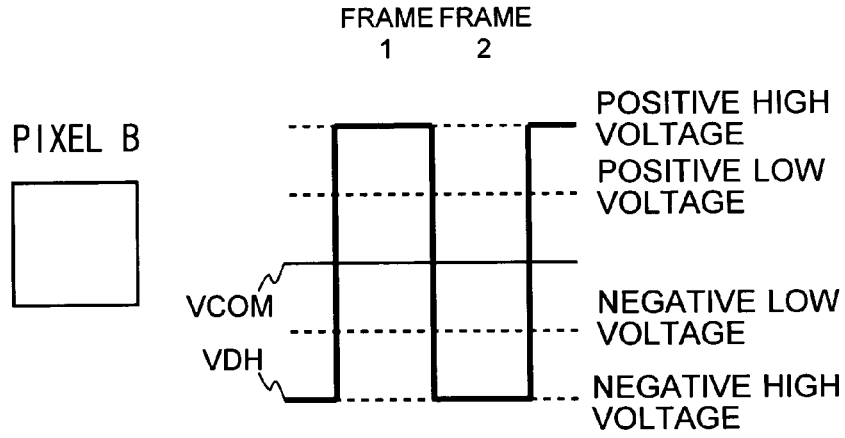
Fig. 21B PRIOR ART
FIG. 21B illustrates a driving voltage in each frame for displaying a pixel B with highest luminance.
Figure 21C:
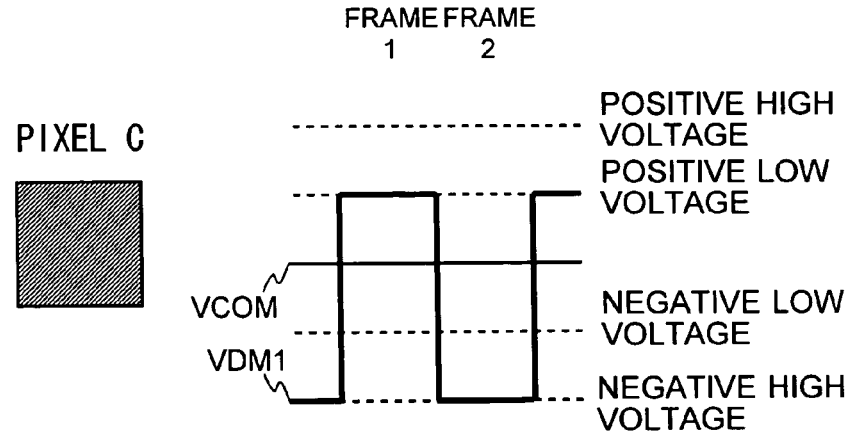
Fig. 21C PRIOR ART
FIG. 21C illustrates a driving voltage in each frame for displaying a pixel C with a middle luminance.
Figure 22A:
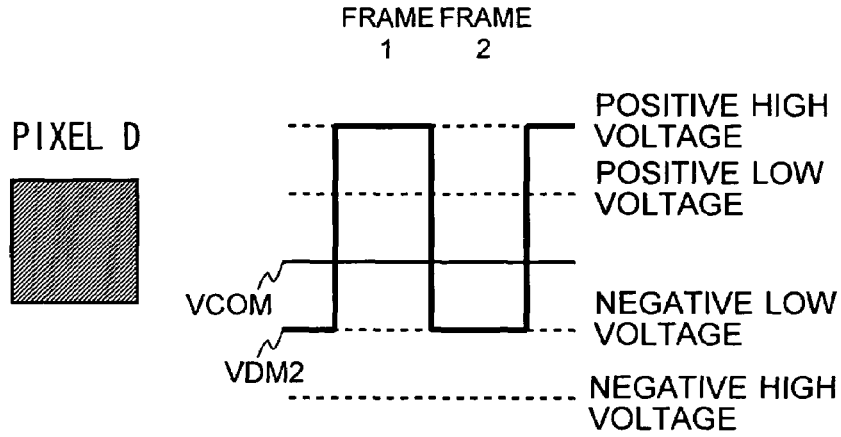
Fig. 22A PRIOR ART
FIG. 22A shows a driving voltage for the first pattern, and a pixel D generated by applying the driving voltage for the first pattern unlike a case shown in FIG. 21C according to the conventional technique.
Figure 22B:
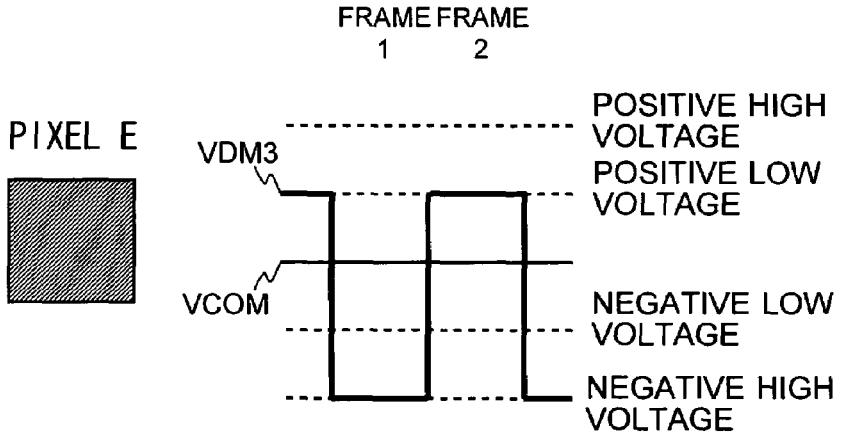
Fig. 22B PRIOR ART
FIG. 22B shows a driving voltage for the second pattern, and a pixel E generated by applying the driving voltage for the second pattern according to the conventional technique.
Figure 22C:
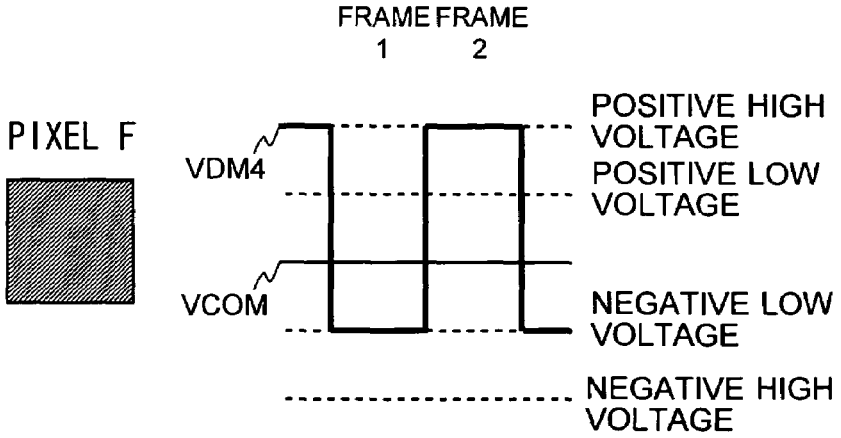
Fig. 22C PRIOR ART
FIG. 22C shows a driving voltage for the third pattern, and a pixel F generated by applying the driving voltage for the third pattern according to the conventional technique.

Here, before describing operations of each functional components of the LCD device in detail, a method for displaying halftone utilizing an FRC technique will be described. The LCD device is configured to apply two different driving voltages (a low voltage and a high voltage) to a predetermined pixel circuit. This configuration enables three-gray-level display shown in FIGS. 21A-21C by using a halftone display method where a unit period for achieving predetermined halftone display (hereinafter, referred to as a "frame period") includes two individual frames. More generally, the LCD device according to one specific embodiment of the invention enables (N+1)-level halftone where the frame period includes N frame (N is a natural number equal to or more than 2). The following example enables 253-gray-level display by applying a plurality of combinations of driving voltages with the frame period of 8 frames, which is twice of 4 frames. Thus, this example may adopt a configuration which uses the frame period of 4 frames for displaying 5 levels of halftone. Specifically, among given 8 bits, the LCD device utilizes the lowest 2 bits for the FRC technique, and the highest 6 bits for determining one of $2^6$ driving voltages. By combining two driving voltages of which voltage difference is the least among these $2^6$ driving voltages, i.e., two adjoining driving voltages in a voltage scale, the LCD device achieves 253-gray-level display ranging gray level 0 to 252 as illustrated in the following table.

TABLE

| Driving Voltages determined by the Highest 6 bits (8-bit digital representation) | | | | | | | | | Gray level (8-bit digital representation) |
|---|---|---|---|---|---|---|---|---|---|
| 0 | 4 | 8 | 12 | . . . | 240 | 244 | 248 | 252 | |
| 8 | 0 | | | | | | | | 0 |
| 6 | 2 | | | | | | | | 1 |
| 4 | 4 | | | | | | | | 2 |
| 2 | 6 | | | | | | | | 3 |
| | 8 | 0 | | | | | | | 4 |
| | 6 | 2 | | | | | | | 5 |
| | 4 | 4 | | | | | | | 6 |
| | 2 | 6 | | | | | | | 7 |
| | | 8 | 0 | | | | | | 8 |
| | | 6 | 2 | | | | | | 9 |
| | | 4 | 4 | | | | | | 10 |
| | | 2 | 6 | | | | | | 11 |
| | | | | | | | | | . . . |
| | | | | | 8 | 0 | | | 240 |
| | | | | | 6 | 2 | | | 241 |
| | | | | | 4 | 4 | | | 242 |
| | | | | | 2 | 6 | | | 243 |
| | | | | | | 8 | 0 | | 244 |
| | | | | | | 6 | 2 | | 245 |
| | | | | | | 4 | 4 | | 246 |
| | | | | | | 2 | 6 | | 247 |
| | | | | | | | 8 | 0 | 248 |
| | | | | | | | 6 | 2 | 249 |
| | | | | | | | 4 | 4 | 250 |
| | | | | | | | 2 | 6 | 251 |
| | | | | | | | 0 | 8 | 252 |

This table shows a relationship between the two adjoining driving voltages applied during the frame period (i.e., 8 frames), and the gray level obtained by the driving voltages, where each value is expressed by 8-bit digital representation. Also, the driving voltages shown above are discrete values determined by the highest 6 bits of the 8-bit digital data. Further, each pair of two values shown in each row in the table represents a number of frames during which a driving voltage corresponding to the associated column is applied. Further, each of the gray levels in the above table is a value obtained as an average luminance during a unit time. Such an average luminance is obtained by dividing a summation of gray levels of a pixel displayed during the frame period by a number of frame periods.

For example, referring to the second line of the above table, the number of frames during which the driving voltage 0 is applied is 6, and the number of frames during which the driving voltage 4 (8-bit digital representation) is applied is 2. Thus, the resulting gray level is calculated as follows: $(0\times6+4\times2)/8=1$ (8-bit digital representation).

Blank entries in the table represent no driving voltage applied for that voltage level. For example, in order to display "gray level 1," only the two adjoining driving voltages of "0" and "4" are used, and no other voltage levels (i.e., 8, 12, . . . , 252) are used.

In this specification, the term "two adjoining driving voltages in a voltage scale" means two discrete driving voltage levels which are located immediately adjacent to each other in a voltage scale with discrete voltage levels.

The above-mentioned image signal typically represents a still picture in which luminances of all pixels are constant during each frame period. Even if the image signal represents a moving picture, the luminances of all pixels are assumed not to vary significantly within a single frame period, and thus, displaying moving pictures does not pose a problem when using embodiments of the invention.

Figures 2A, 2B, 3:
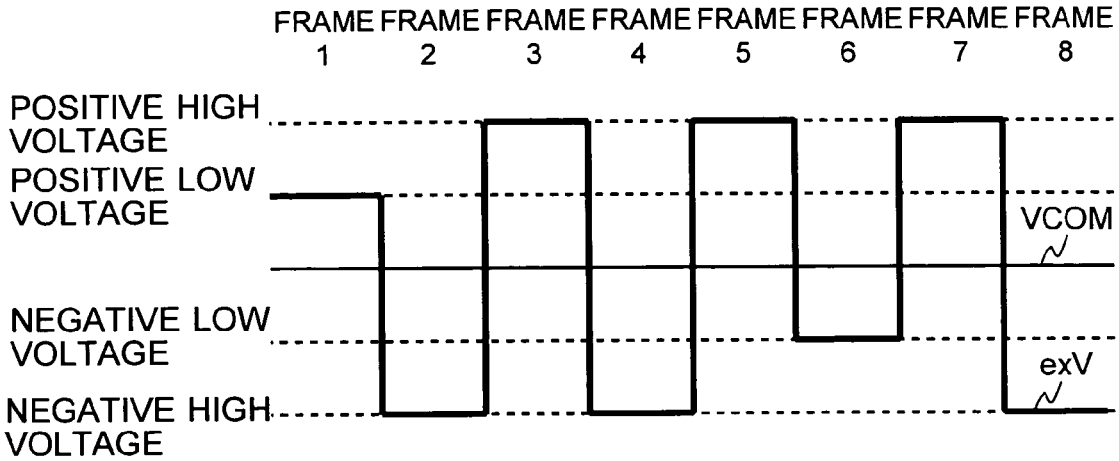
FIG. 2A illustrates an example of waveform when two different driving voltages of a high voltage or a low voltage are applied with polarity changes to a predetermined liquid crystal element according to the one of the embodiments.
FIG. 2B illustrates the waveform example shown in FIG. 2A by a table format which contains symbols representing polarities.
FIG. 3 illustrates a pixel pattern including 2×2 pixels according to the one of the embodiments.

Next, voltage waveforms and polarities applied where the frame period of 8 frames discussed above is utilized are now described. FIG. 2A illustrates an example of waveform when two different driving voltages of a high voltage or a low voltage are applied to a predetermined liquid crystal element with polarity changes, and FIG. 2B illustrates the waveform example shown in FIG. 2A by a table format which contains symbols representing polarities. In FIG. 2A, the waveform example is referred to as exV. In FIG. 2B, "H+" represents a high voltage with a positive polarity (positive high voltage), "H-" represents a high voltage with a negative polarity (negative high voltage), "L+" represents a low voltage with a positive polarity (positive low voltage), and "L-" represents a low voltage with a negative polarity (negative low voltage).

As illustrated in FIGS. 2A and 2B, each liquid crystal element in the liquid crystal panel 8 needs to be driven by an AC (alternate current) voltage due to its nature associated with liquid crystal, and thus, is AC driven by using a frame inverting method in which a polarity of the applied voltage is inverted in every frame. In other words, each liquid crystal element is supplied with a driving voltage having different polarities in two adjoining frames. Therefore, in this specification, the term "driving voltage" simply means an absolute value of the driving voltage irrespective of whether the driving voltage is positive or negative, such as a high voltage ("H") and a low voltage ("L").

Further, this liquid crystal panel 8 performs AC driving of a line inverting method in which polarities of the applied voltages of adjoining lines are inverted. Here, supposing that a gray level of a pixel supplied with a high voltage during all 8 frames is 100%, and a gray level of a pixel supplied with a low voltage during all 8 frames is 0%, a gray level of a pixel represented by the waveform exV would be 75% since 6 frames out of 8 frames are applied with a high voltage, and the remaining 2 frames are applied with a low voltage.

In addition, the LCD device also utilizes a spatial halftone display method in which a pixel pattern including 4 pixels is used as a "unit of display." FIG. 3 illustrates a pixel pattern including 2×2 pixels which are the unit of display. This unit of display is hereinafter referred to as a "2×2 pixel pattern" or a "pixel pattern." The symbols a-d shown in the figures represent pixels a-d, respectively. Here, a pixel formed by applying a higher voltage between two adjoining voltages is referred to as a "bright pixel," while a pixel formed by applying a lower voltage between the two adjoining voltages is referred to as a "dark pixel." By using a combination of the bright pixel and the dark pixel, a pixel pattern can display 5 gray levels. FIG. 4 illustrates a pixel pattern obtained by a combination of 4 pixels, and a resulting gray level obtained by the pixel pattern. In FIG. 4, a white box represents the bright pixel, and a black box represents the dark pixel.

The LCD device according to one embodiment of the invention displays five gray levels shown in FIG. 4 by utilizing the pixel pattern shown in FIG. 3, thereby filling the display screen of the liquid crystal panel with a plurality of the pixel patterns. FIG. 5 illustrates an example of positioning the pixels in the liquid crystal panel. As illustrated in FIG. 5, the LCD device spatially diffuses pixels formed by applying the same driving voltage over the display screen in order to eliminate the above-described flicker component spatially.

In this specification, the term "eliminate" does not necessarily mean complete removal of a certain effect. For example, "to eliminate" of flicker components includes a case in which all of, or only a portion of the flicker components are removed.

Further, as described later, the LCD device sets phases of the driving voltages for forming the pixel a, b, c and d not to be the same as much as possible, thereby further eliminating flicker. It should be appreciated that the above-described 2×2 pixel pattern is only exemplary to describe a specific embodiment of the invention, and thus, various embodiments utilizing other suitable numbers of pixels or other suitable pixel patterns may be implemented.

Next, each functional block of the LCD device shown in FIG. 1 will be now described. As described above, the LCD device includes each functional block for each color of R, G and B in order to process each of R, G and B. When a full color image signal is processed, each functional block performs the same operation separately for each color of R, G and B. Thus, for the sake of simplicity, only processing operation for a green color component will be described below referring to FIG. 1.

The data splitter 1 separates 8-bit digital data given externally as an image signal into the highest 6 bits and the lowest 2 bits. The pixel location detecting circuit 2 detects which one of the pixels a, b, c and d in the 2×2 pixel pattern shown in FIG. 3 a pixel location represented by the current digital data corresponds to, based on a control signal received together with the above-described digital data, and outputs the detected location as pixel location information. The frame number determining circuit 3 counts up such that each frame included in the frame period is assigned a sequentially ascending number, thereby determining which position of the frames in the frame period the current frame is, and outputs the determined position as frame number information. The applied timing memory circuit 4 stores "high" or "low" of the driving voltage (i.e., whether a high voltage or a low voltage should be applied) determined by the above-described highest 2 bits in the digital data, and stores a polarity of the driving voltage, in the ascending order of the frame. The order of applying the driving voltages stored in the applied timing memory circuit 4 will now be described in detail below.

Figure 6:
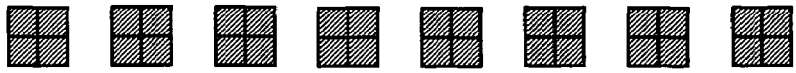
FIG. 6 illustrates the driving voltages for the pixels a, b, c and d in each frame when the lowest 2 bits in the digital data are "00" according to the one of the embodiments.
Figure 7:
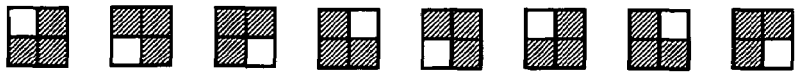
FIG. 7 illustrates the driving voltages for the pixels a, b, c and d in each frame when the lowest 2 bits in the digital data are "01" according to the one of the embodiments.
Figure 8:
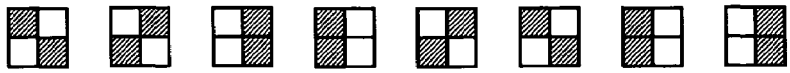
FIG. 8 illustrates the driving voltages for the pixels a, b, c and d in each frame when the lowest 2 bits in the digital data are "10" according to the one of the embodiments.
Figure 9:
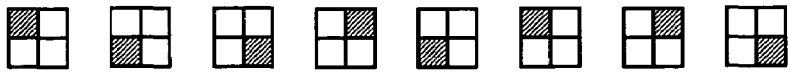
FIG. 9 illustrates the driving voltages for the pixels a, b, c and d in each frame when the lowest 2 bits in the digital data are "11" according to the one of the embodiments.

FIG. 6 illustrates the driving voltages for the pixels a, b, c and d in each frame when the lowest 2 bits in the above-described digital data are "00." Similarly, FIGS. 7, 8 and 9 illustrate the driving voltages for the pixels a, b, c and d in each frame when the lowest 2 bits in the digital data are "01," "10," "11," respectively. Symbols used in these figures are the same as those used in FIG. 2B, and the pixel patterns are the same as those shown in FIG. 4. Also, the gray level name represents one of 5 levels in the gray levels where the darkest gray level is represented by gray level 1. The applied voltage name consists of the digits of the lowest 2 bits, and the displayed pixel name.

It is noted that the driving voltages in each frame for the brightest gray level, i.e., gray level 5, is not shown. In such a case, the driving voltages for the pixels a, b, c and d in each frame shown in FIG. 6 are not all set to be high, but are all set to be low where the two adjoining driving voltages are increased by one level as indicated in the table presented above.

Here, referring to FIGS. 7-9, the "phases" of the driving voltages for the pixels a, b, c and d are not set to be the same. For example, referring to FIG. 7, the applied voltage 01*a* has its H voltages (corresponding to a bright pixel) at frames 1 and 6, while the applied voltage 01*b* has its H voltages at frames 4 and 7. Similarly, the applied voltages 01*c* and Old have their H voltages at frames 3 and 8; and 2 and 5, respectively. In other words, the driving voltages for pixels a-d are out of phase with each other.

According to one of embodiments of the invention, luminances of the two adjoining pixels in one frame can be different, while luminances of the two adjoining pixels in another frame can be the same. As a result, flicker is reduced in the entire unit frame. It should be appreciated that the orders of applying the driving voltages shown in these figures are exemplary, and that other various orders of applying the driving voltages may be employed.

Further referring to FIGS. 7-9, for each driving voltage of high voltage or low voltage in a frame period, the number of applying the positive voltage, and the number of applying the negative voltage are the same. Therefore, an average luminance of each pixel which should be the same luminance (or the same gray level) is actually uniform, thereby improving display quality.

Further referring to FIGS. 6-9, the LCD device is configured such that the number of applying each driving voltage (high voltage or low voltage) during the first half of the frame period of 8 frames (frame numbers 1-4) is the same as the number of applying each driving voltage during the latter half of the frame period of 8 frames (frame numbers 5-8). As a result, the average luminance during the first 4 frames is substantially the same as the average luminance during the last 4 frames, thereby reducing or eliminating generation of flicker, and enabling high quality display.

An LCD device according to an exemplary embodiment of the invention is configured such that the number of applying each driving voltage (high voltage or low voltage) during the first half containing N frames of the frame period is the same as the number of applying each driving voltage during the latter half containing N frames of the frame period where the frame period is 2N frames. Thus, the average luminance during the first N frames is substantially the same as the average luminance during the last N frames. As a result, the LCD device enables high quality display by reducing generation of flicker during the frame period.

Again referring to FIG. 6-9, an LCD device according to another specific embodiment of the invention is configured such that the driving voltage for frame number 1 is equal to the driving voltage for frame number 6, the driving voltage for frame number 2 is equal to the driving voltage for frame number 5, the driving voltage for frame number 3 is equal to the driving voltage for frame number 8, and the driving voltage for frame number 4 is equal to the driving voltage for frame number 7.

To put in a more general way, the LCD device according to one specific embodiment may be configured such that the driving voltage for the k-th frame (here, k is an odd number less than N) is equal to the driving voltage for the (N+k+1)-th frame, and the driving voltage for the (k+1)-th frame is equal to the driving voltage for the (N+k)-th frame where the frame period includes 2N frames, and N is an even number.

When N is an odd number, the LCD device according to one specific embodiment may be configured such that the driving voltage for m-th frame (here, m is a natural number equal to or less than N) is equal to the driving voltage for (m+N)-th frame. For example, when the frame period includes 6 frames (i.e., N=3), the LCD device may be configured such that the driving voltage for frame number 1 is equal to the driving voltage for frame number 4, the driving voltage for frame number 2 is equal to the driving voltage for frame number 5, and the driving voltage for frame number 3 is equal to the driving voltage for frame number 6.

By configuring the LCD device in the above-described manner, the number of applying the same driving voltage in the adjoining frames is minimized while, for each driving voltage of a high voltage or a low voltage during the frame period, the number of applying positive voltages is kept to be the same as the number of applying negative voltages.

According to the above-described scheme, frames assigned to the same driving voltage (a high voltage or a low voltage) are diffused (or substantially evenly positioned) within the frame period, and thus, display quality is further improved. In other words, one exemplary embodiment of the invention enables removal of "temporal periodicity."

The applied voltage determining circuit 5 receives the lowest 2 bits of the above-described digital data, the pixel location information output by the pixel location detecting circuit 2, and the frame number information output by the frame number determining circuit 3. The applied voltage determining circuit 5 then determines driving voltages to be applied to each pixel circuit based on the applying order stored in the applied timing memory circuit 4 as described above, and supplies a 1-bit high/low information, which is "1" when the determined driving voltage is a high voltage, and "0" when the determined driving voltage is a low voltage, to the summation process circuit 6.

The summation process circuit 6 provides the liquid crystal panel 8 with 6-bit data obtained by adding one bit of the above-described high/low information given by the applied voltage determining circuit 5 to the highest 6 bits of the digital data given by the data splitter 1. In this summation process, the output data is overflown when the digital data is "111111," and the high/low information "1." In order to avoid the overflow, in such a case, the process result is set to be "111111."

The timing adjusting circuit 7 adjusts display timing in a suitable manner by delaying the above-described control signal by a time period necessary for the signal process. The liquid crystal panel 8 displays a predetermined image based on the 6-bit digital data for each color of R, G and B from the summation process circuit 6, and the control signal from the timing adjusting circuit 7.

Figures 10, 11:
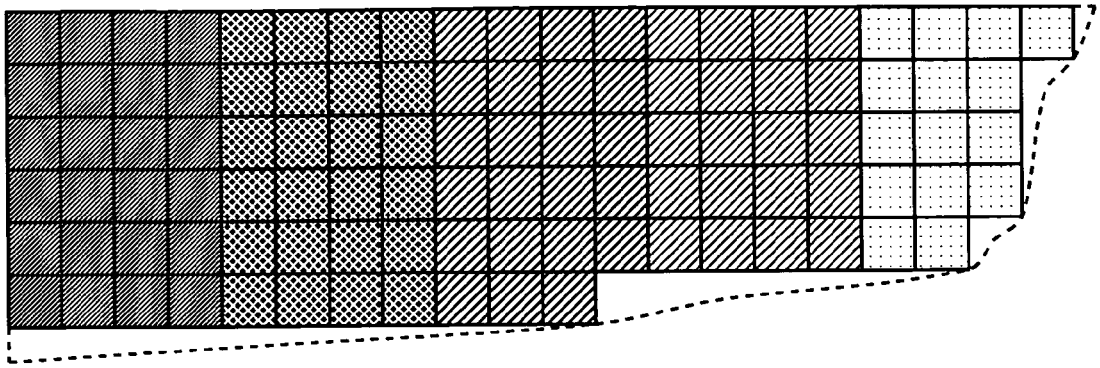
FIG. 10 illustrates a left-upper portion of the image represented by an image signal supplied to the LCD device according to the one of the embodiments.
FIG. 11 illustrates 8-bit digital data corresponding to the gray level (and polarity) for each pixel shown in FIG. 10.
Figure 12:
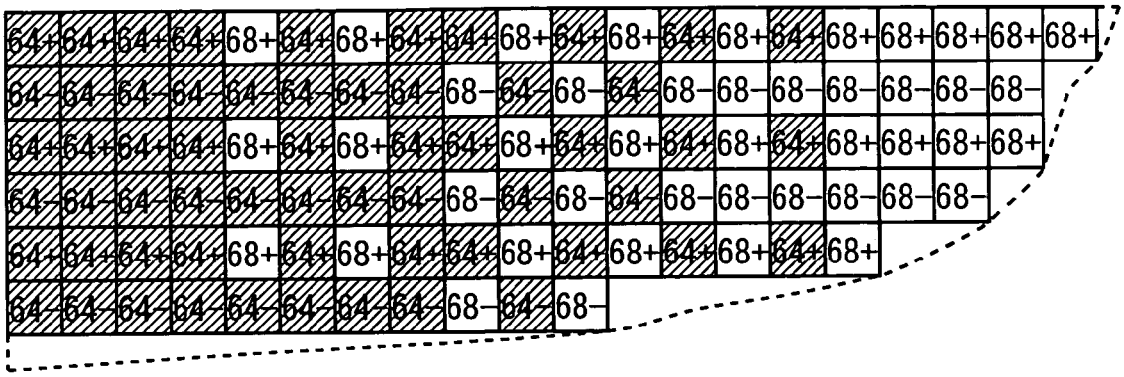
FIG. 12 illustrates digital data representing a gray level for each pixel in the frame number 1 according to the one of the embodiments.
Figure 13:
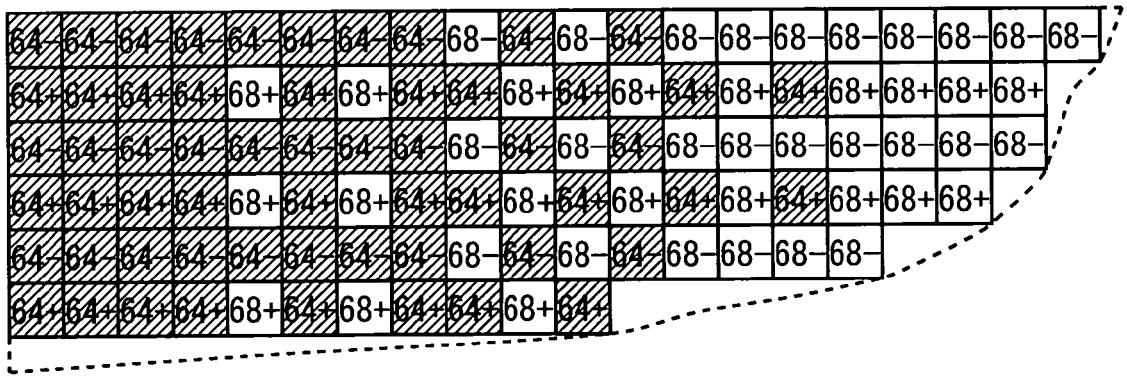
FIG. 13 illustrates digital data representing a gray level for each pixel in the frame number 2 according to the one of the embodiments.
Figure 18:
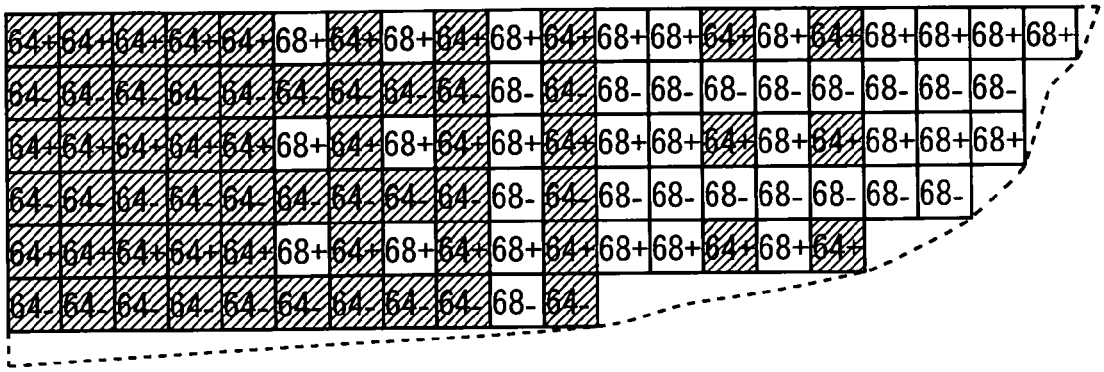
FIG. 18 illustrates digital data representing a gray level for each pixel in the frame number 7 according to the one of the embodiments.
Figure 19:
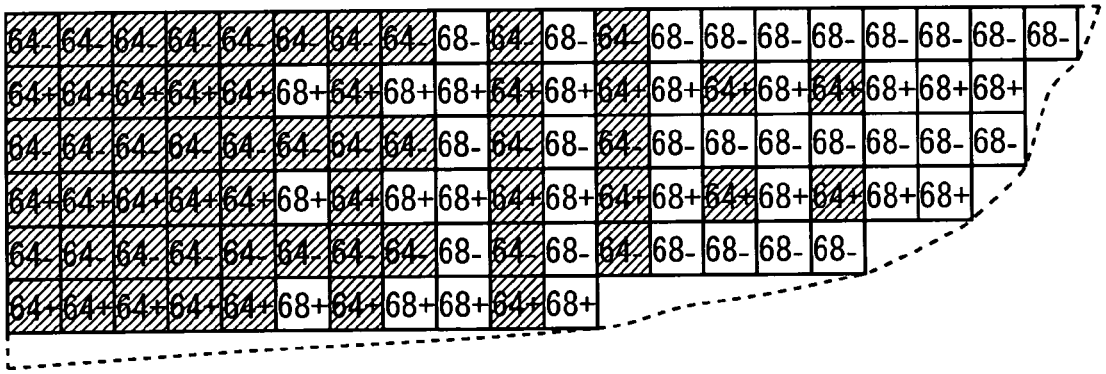
FIG. 19 illustrates digital data representing a gray level for each pixel in the frame number 8 according to the one of the embodiments.

Next, an example in which an actual image signal is supplied to the LCD device to be processed will be described. FIG. 10 illustrates a left-upper portion of the image represented by an image signal supplied to the LCD device. This image signal represents a still picture image, and represents a gray scale image in which the gray level is increased by one as the horizontal position shifts to the right by 4 pixels. FIG. 11 illustrates 8-bit digital data corresponding to the gray level (and polarity) for each pixel shown in FIG. 10. FIGS. 12-19 illustrate digital data shown in FIG. 11 processed by the LCD device for each frame. Specifically, FIGS. 12, 13, 14, 15, 16, 17, 18, and 19 illustrate digital data representing a gray level for each pixel in the frame numbers 1, 2, 3, 4, 5, 6, 7, and 8, respectively. It is noted that the gray levels shown in these figures illustrate the gray level number and its polarity on a liquid crystal panel display employing a line inverting method utilized in the LCD device according to an exemplary embodiment of the invention. The gray level number is represented by 8-bit expression of 8-bit digital data expanded by adding 2-bit data "00" to the lowest digits of the 6-bit data representing the driving voltage. Also, a refresh rate of the LCD device is 60 Hz, and thus, eight frame images from frame number 1 to frame number 8 are cyclically displayed at a 16.67 ms interval in a sequential ascending order of the frame number. Even though an FRC technique is used, the above-described halftone display method does not cause luminance differences for human eyes between pixels, and nor does it cause stripe-shaped luminance variations.

The LCD device according to the embodiment of the invention uses a horizontal line inverting method that is one of line inverting methods in which two adjoining lines are driven with the polarity inverted as an AC driving method. However, it should be appreciated that vertical line inverting methods in which two adjoining columns are driven with the polarity inverted, or dot inverting methods in which two adjoining dots are driven with the polarity inverted may be used for embodiments of the invention.

In the above-described LCD device according to the exemplary embodiment of the invention, the spatial halftone display technique for reducing the spatial periodicity using pixel patterns shown in FIGS. 3-5 is utilized together with the temporal halftone technique shown in FIGS. 6-9. However, it should be appreciated that only the temporal halftone technique may be utilized. In a case where only the temporal halftone technique is used, the LCD device is configured such that, for the same driving voltage (a high voltage or a low voltage), the driving voltage with a positive polarity and the driving voltage with a negative polarity are the same in the number of occurrences within the frame period. Therefore, the average luminances of pixels which should have the same luminances are the same with each other, and thus, display quality of the LCD device is improved.

According to various embodiments of the invention, all of, or a part of functional blocks for processing signals or data may be implemented by any suitable combination of hardware and/or software.

While the invention has been described in detail, the foregoing description is in all aspects illustrative and not restrictive. It is understood that numerous other modifications and variations can be devised without departing from the scope of the invention.

The period application is an application which claims priority from Japanese patent application No. 2003-175251 filed on Jun. 19, 2003, entitled "METHOD AND APPARATUS FOR DISPLAYING HALFTONE IN A LIQUID CRYSTAL DISPLAY," the entirety of which is incorporated herein by reference for all purposes.

What is claimed is:

1. A method for displaying (1+N)-level (N is a natural number more than 2) halftone in a liquid crystal display based on a first and a second driving voltages selected for a predetermined unit period among a plurality of predetermined driving voltages, one of the first and the second driving voltages being set for each of frames included in the unit period, and a poiarity of the one of the first and the second driving voltages being inverted for every one or more frames, the method comprising:

generating the first driving voltage and the second driving voltage such that a number of frames to which the first driving voltage having a positive polarity is assigned is the same as a number of frames to which the first driving voltage having a negative polarity is assigned, and such that a number of frames to which the second driving voltage having a positive polarity is assigned is the same as a number of frames to which the second driving voltage having a negative polarity is assigned, where the unit period includes 2N frames.

2. The method of claim 1, wherein a number of frames to which the first driving voltage is assigned in a first half containing N frames in the unit period is the same as a number of frames to which the first driving voltage is assigned in a latter half containing N frames in the unit period, and wherein a number of frames to which the second driving voltage is assigned in the first half containing N frames in the unit period is the same as a number of frames to which the second drMng voltage is assigned in the latter half containing N frames in the unit period.

3. The method of claim 2, the driving voltage for the k-th frame in the unit period is equal to the driving voltage for the (N+k+1)-th frame in the unit period, and the driving voltage for the (k+1)-th frame in the unit period is equal to the driving voltage for the (N+k)-th frame in the unit period where N is an even number, and k is an odd number less than N, and wherein the driving voltage for m-th frame in the unit period is equal to the driving voltage for (m+N)-th frame in the unit period where N is an odd number, and m is a natural number equal to or less than N.

4. The method of claim 3, wherein the driving voltage for the first frame in the unit period is equal to the driving voltage for the sixth frame in the unit period, wherein the driving voltage for the second frame in the unit period is equal to the driving voltage for the fifth frame in the unit period, wherein the driving voltage for the third frame in the unit period is equal to the driving voltage for the eighth frame in the unit period, and wherein the driving voltage for the fourth frame in the unit period is equal to the driving voltage for the seventh frame in the unit period.

5. The method of claim 1, wherein, in order to display multi-level level tones for a display unit including a plurality of pixels, the first and the second driving voltages are set to display a predetermined gray level for each pixel included in the display unit.

6. An apparatus for displaying (1+N)-level (N is a natural number equal to or more than 2) halftone in a liquid crystal display in response to display data given external to the apparatus, based on a first and a second driving voltages selected for a predetermined unit period among a plurality of predetermined driving voltages, one of the first and the second driving voltages being set for each of frames included in the unit period, a polarity of the one of the first and the second driving voltages being inverted every one or more frames, the apparatus comprising:

a voltage determining circuit for generating the first driving voltage and the second driving voltage such that a number of frames to which the first driving voltage having a positive polarity is assigned is the same as a number of frames to which the first driving voltage having a negative polarity is assigned, and such that a number of frames to which the second driving voltage having a positive polarity is assigned is the same as a number of frames to which the second driving voltage having a negative polarity is assigned, where the unit period includes 2N frames; and a display portion for displaying multi-level tones based on the driving voltages generated by the voltage determining circuit.

7. The apparatus of claim 6, wherein the voltage determining circuit includes a frame determining circuit for determining a frame corresponding to the display data among 2N frames constituting the unit period, a timing memory circuit for storing the driving voltages assigned to the unit period in association with a frame included in the unit period, and an applied voltage determining circuit for applying to the display portion, based on the frame determined by the frame determining circuit, the driving voltages associated with the determined frame stored in the timing memory circuit.

8. The apparatus of claim 6, wherein, in order to display multi-level tones for a display unit including a plurality of pixels, the voltage determining circuit sets the first and the second driving voltages to display a predetermined gray level for each pixel included in the display unit.

* * * * *